US005833189A

United States Patent [19]

Rossman et al.

[11] Patent Number: 5,833,189

[45] Date of Patent: Nov. 10, 1998

[54] CLAMP FOR MOUNTING CHILDREN'S ARTICLES TO A SURFACE

[75] Inventors: Jon R. Rossman, Chelmsford; Bryan R. Hotaling, Arlington, both of Mass.

[73] Assignee: The First Years Inc., Avon, Mass.

[21] Appl. No.: 736,566

[22] Filed: Oct. 25, 1996

[51] Int. Cl.[6] ..... A47B 96/06

[52] U.S. Cl. ..... 248/231.61; 248/221.11; 248/227.4; 248/224.8; 248/231.41

[58] Field of Search ..... 248/231.61, 304.1, 248/231.41, 214, 228.5, 311.2, 316.4, 228.6, 230.3, 230.5, 230.6, 226.4, 231.71, 346.03, 224.8, 224.7, 225.11, 227.2, 227.4, 231.85; 446/227

[56] References Cited

U.S. PATENT DOCUMENTS

| | | | |
|---|---|---|---|
| 2,461,256 | 2/1949 | Black | 248/231.61 |
| 2,708,088 | 5/1955 | Steinke | 248/309.1 |
| 2,867,401 | 1/1959 | Sheahan | 248/226 |
| 2,940,715 | 6/1960 | Schultz et al. | 248/226 |
| 3,180,605 | 4/1965 | Ewaskowitz, Jr. | 248/226 |
| 3,939,986 | 2/1976 | Pierro | 211/74 |
| 3,978,610 | 9/1976 | Stubbmann | 46/32 |
| 4,301,767 | 11/1981 | Willinger et al. | 248/214 |
| 4,453,339 | 6/1984 | Cook | 446/227 |
| 4,491,902 | 1/1985 | Cangelosi | 362/389 |
| 4,573,654 | 3/1986 | Nottingham | 248/231.1 |
| 4,575,149 | 3/1986 | Forestal et al. | 248/231.41 |
| 4,640,034 | 2/1987 | Zisholtz | 40/455 |
| 4,904,220 | 2/1990 | Williams et al. | 446/227 |
| 5,237,767 | 8/1993 | Kringel et al. | 40/642 |
| 5,370,570 | 12/1994 | Harris | 446/227 |
| 5,626,321 | 5/1997 | Ulshafer | 248/231.41 |
| 5,659,904 | 8/1997 | Doczy | 248/228.3 |

*Primary Examiner*—Leslie A. Braun
*Assistant Examiner*—Gwendolyn W. Baxter
*Attorney, Agent, or Firm*—Fish & Richardson P.C.

[57] ABSTRACT

An attachment system for attaching a children's article, e.g., a toy or feeding bowl, to another object is provided. The attachment system includes (a) a children's article, and (b) an attachment device. The children's article includes (i) a base having a substantially planar base surface having a predetermined length and width, and a first interlocking portion; and (ii) a children's article mounted on the base. The attachment device includes (i) a clamp constructed to be removably mounted on a portion of the object, the clamp having an inner surface, adjacent the object when the clamp is in use, and an outer surface; and (ii) an article receiving portion, disposed on the outer surface, comprising a substantially planar, recessed surface, having a predetermined length and width substantially equal to the predetermined length and width of the base, and having a second interlocking portion constructed for engagement with the first interlocking portion to resist movement of the article relative to the attachment device after the article has been received by the article receiving portion.

16 Claims, 3 Drawing Sheets

CLAMP FOR MOUNTING CHILDREN'S ARTICLES TO A SURFACE

BACKGROUND OF THE INVENTION

The present invention relates to devices for attaching a children's article, e.g., a toy or a feeding device such as a bowl, to another object, e.g., a child's high chair tray, a table or the like. The invention further relates to children's articles, e.g., toys, for use with such devices.

Adults often wish to mount a toy or other article within view and/or reach of an infant who is restricted in a high chair or other seating/confining device. In the case of a toy, this is useful to amuse and entertain the infant and also to improve the attention span and motor skills of the infant. In the case of a bowl, this allows the infant to be fed without the infant knocking the bowl over or off of the tray of the high chair. It is desirable that a device for mounting an article in this manner be easy to attach and remove from the object on which the article is to be mounted, and provide secure attachment to resist removal by the infant.

SUMMARY OF THE INVENTION

In one aspect, the invention features a children's article attachment system for attaching a toy or other children's article to another object. The attachment system includes: (a) a children's article, and (b) an attachment device. The children's article includes (i) a base having a substantially planar base surface having a predetermined length and width, and a first interlocking portion; and (ii) an article mounted on the base. The children's article may also include (iii) a support member interposed between the base and the article to support the article above the upper surface of the base. The attachment device includes (i) a clamp constructed to be removably mounted on a portion of the object, the clamp having an inner surface, adjacent the object when the clamp is in use, and an outer surface; and (ii) an article receiving portion, disposed on the outer surface, comprising a substantially planar, recessed surface, having a predetermined length and width substantially equal to the predetermined length and width of the base, and having a second interlocking portion constructed for engagement with the first interlocking portion to resist movement of the base relative to the attachment device after the base has been received by the article receiving portion.

In another aspect, the invention features an attachment device as described above.

Preferred embodiments include one or more of the following features. The clamp is constructed to be removably mounted on the object. The object is a high chair tray. The clamp comprises a C-shaped member dimensioned to fit around a portion of the object. The C-shaped member comprises a pair of J-shaped members having curved portions and straight portions, constructed to be snapped together so that their curved portions are opposed and their straight portions are adjacent each other. The J-shaped members are permanently associated with each other, and are movable relative to each other between a first, open position, in which the curved portions of the J-shaped members are spaced relatively distant from one another, and a second, closed position, in which the curved portions are spaced relatively closer to each other. One of the J-shaped members includes a tab and the other of the J-shaped members includes an opening constructed to receive the tab in interlocking engagement. The tab includes a camming surface and a resilient hinged portion to facilitate insertion of the tab into and removal of the tab from the opening. One of the J-shaped members further comprises a pair of protrusions, and the other of the J-shaped members includes a pair of openings constructed to receive the protrusions in slidable locking engagement, allowing the J-shaped members to be moved a fixed distance relative to each other, from a position in which the clamp is closed to a position in which the clamp is partially open. The first interlocking portion of the children's article comprises an edge portion disposed around the periphery of the base, and the second interlocking portion of the article receiving portion comprises a pair of retaining members constructed to extend over a region of the edge portion when the base is received by the article receiving portion. The second interlocking portion further comprises a tab that is resiliently moveable between a first position in which it allows the base surface to slide across the recessed surface, and a second, normal, position in which the tab restricts movement of the base relative to the article receiving portion. The tab includes a camming surface constructed to facilitate movement of the tab from the second to the first position during insertion of the base into the article receiving portion.

Advantageously, the children's article attachment system of the invention allows a toy or other children's article to be easily mounted on and removed from an object such as a high chair tray or a table or similar surface. The article is mounted securely, yet can be readily removed and replaced by another article. The attachment device can also be easily mounted and removed. In the embodiment in which the attachment device comprises a C-shaped clamp including two J-shaped members that snap together, that are permanently associated with each other, and that are movable between a relatively open position and a relatively closed position, the attachment device can be easily snapped onto an object using only one hand.

The term "high chair"as used herein is intended to include not only standard high chairs having metal trays and rails, but also other types of chairs suitable for use by infants and children, e.g., chairs having trays that are shaped to be used with the attachment device of the invention. The term "children's article", as used herein, refers to any type of article that is suitable for use by a child or infant or by the child's parent in caring for the child, including but not limited to toys and feeding devices such as bowls or cups.

Other features and advantages of the invention will be apparent from the description of preferred embodiments thereof, taken together with the drawings, and from the claims.

DESCRIPTION OF THE PREFERRED EMBODIMENTS

Figure 1:
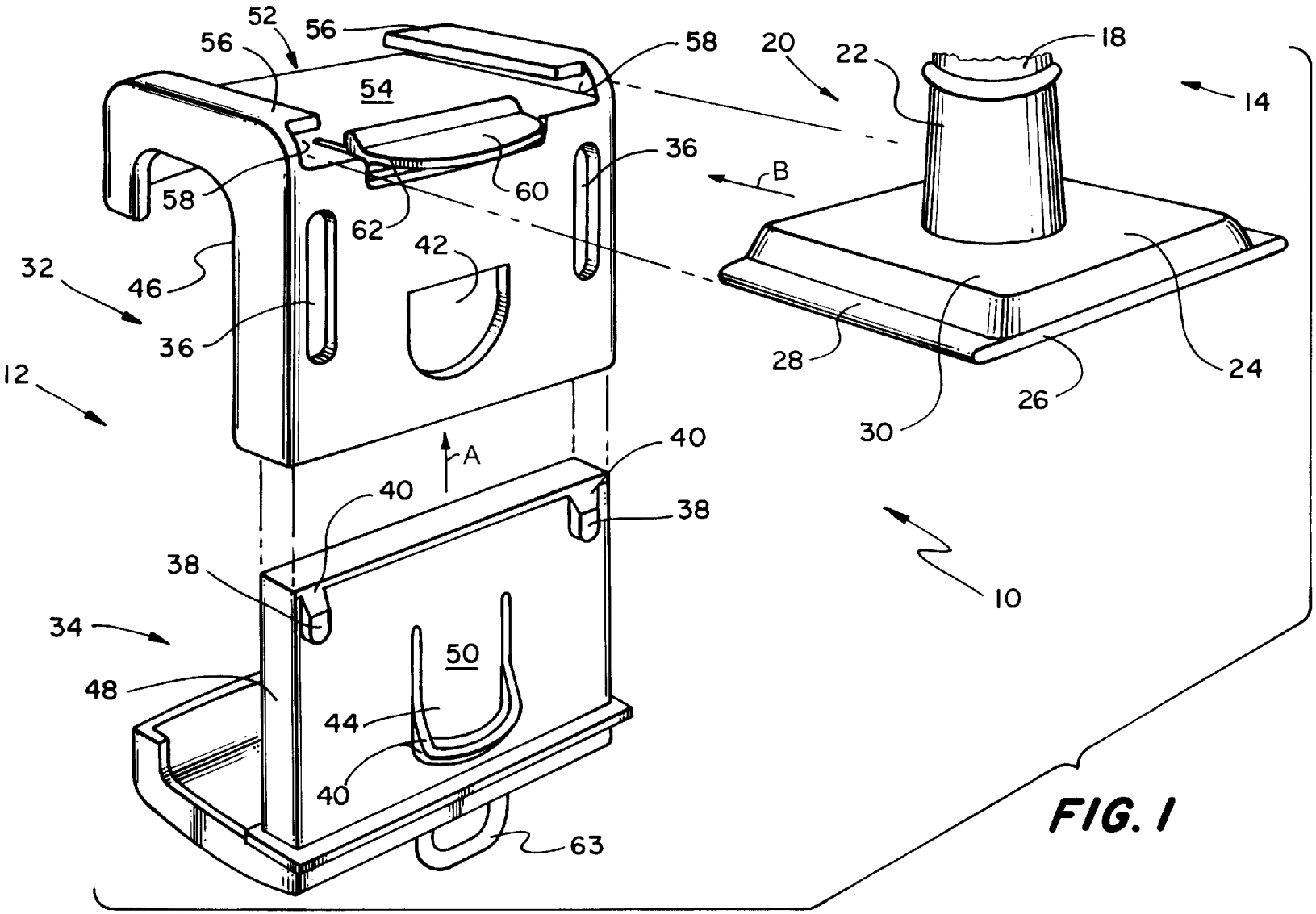
FIG. 1 is a schematic exploded perspective view of a children's article attachment system according to one embodiment of the invention.
Figure 2:
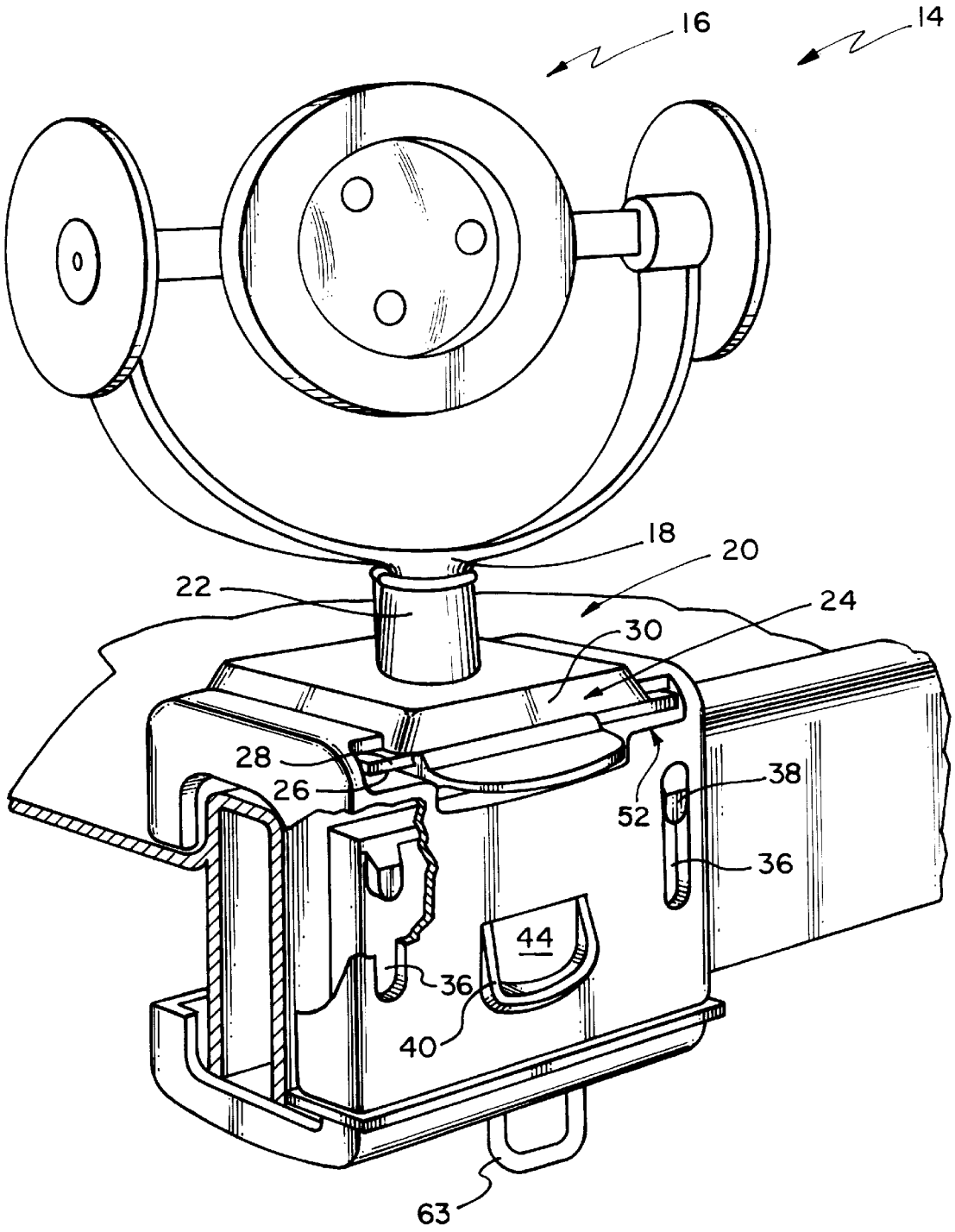
FIG. 2 is a perspective view of the children's article attachment system shown in FIG. 1 in its assembled state, partially broken away to show the engagement of side walls 46 with side walls 48.
Figure 3:
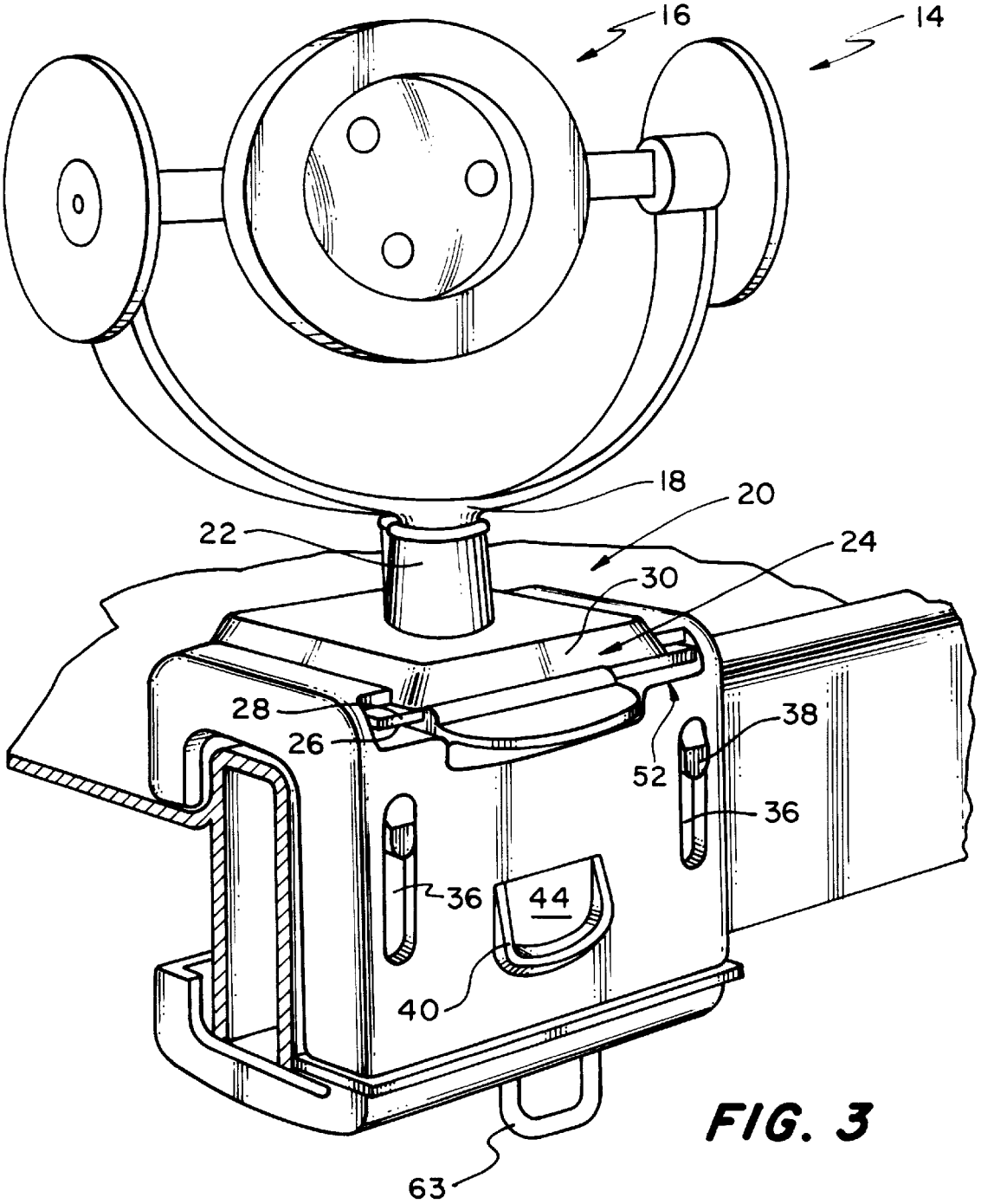
FIG. 3 is a perspective view of the children's article attachment system of FIGS. 1 and 3 assembled and in place around a high chair tray (shown in partial cross-section).

Referring to FIG. 1, a children's article attachment system 10 includes a clamp 12 and a children's article, e.g., a toy device 14 (FIG. 2).

Toy device 14 includes a toy 16, mounted on a member 18 which extends outwardly from a base 20.

The member 18 may be rigid, to maintain the toy in a stationary position, or flexible, to allow the toy to be moved by the infant, and may have any desired length and cross-sectional shape, e.g., round or square.

The base 20 includes a cylindrical or frustoconical supporting member 22, and a base member 24 having a substantially planar surface 26 and a peripheral edge portion 28, the edge portion having a reduced thickness relative to the inner portion 30.

Clamp 12 includes a pair of opposed J-shaped members 32, 34, that snap together, in the direction of arrow A (FIG. 1), to form the assembled C-shaped clamp shown in FIG. 2. In one preferred embodiment, the C-shaped clamp is dimensioned to fit the edge of a tray of a high chair or table. The C-shaped clamp is assembled by interlocking engagement of corresponding protrusions on one member with openings on the other, as described below. Preferably, once assembled, the C-shaped clamp cannot be easily disassembled. The clamp 12 is made of a strong plastic material such as ABS.

First J-shaped member 32 includes a pair of elongated openings 36, constructed to receive protrusions 38 on second J-shaped member 34 in locking, slidable engagement. Protrusions 38 and moveable tab 44 include inclined camming surfaces 40 to allow the two J-shaped members to slide over each other during insertion of the protrusions/tab into the corresponding openings to facilitate initial assembly of the clamp. Once the clamp is assembled, protrusions 38 are locked within the openings 36, but are able to slide along the length of the elongated openings 36 a fixed distance. This sliding movement of the protrusions within the openings enables the clamp to be moved between a closed position, in which it engages an object, and a partially open position, in which it can be placed on or removed from an object. This movement between two positions allows the clamp to be easily snapped in place on an object by an adult using only one hand, allowing the adult to have the other hand free.

The sliding engagement between protrusions 38 and openings 36 also serves to guide and align the J-shaped members so that the side walls 46 of the first J-shaped member 32 slide over the side walls 48 of the second J-shaped member (FIG. 2), and so that the moveable tab 44 is positioned correctly for insertion through the opening 42.

First J-shaped member 32 further includes an opening 42, constructed to receive a moveable tab 44 on second J-shaped member 34. When the user closes the clamp, the inner wall of the first J-shaped member 32 slides over camming surface 40 of tab 44, causing tab 44 to deflect inward about its hinge area 50. When opening 42 and tab 44 are aligned, tab 44 springs resiliently back to its normal position and is received by opening 42 in interlocking engagement. This interlocking engagement holds the clamp securely in its closed position, yet can be easily released simply by deflecting tab 44 to release it from opening 42. When tab 44 is released, the clamp can be easily moved from its closed position to its open position simply by sliding the J-shaped members apart.

Figure 4:
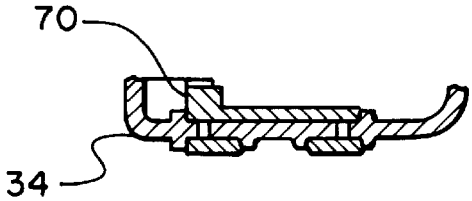
FIG. 4 is a fragmentary cross sectioned view of the lower J-shaped member of the children's article attachment system.

The engagement of protrusions 38 with openings 36 provides further resistance to relative movement of the J-shaped members when the clamp is in its closed position. Additionally, as shown in FIG. 4, a particular embodiment includes a polyvinyl chloride (PVC) insert 70, extending through the lower wall of member 34, for engaging the underside of the object to inhibit lateral sliding movement of the clamp 12 along the object to which it is attached.

To allow the toy device 14 to be mounted on the clamp, clamp 12 includes a toy receiving portion 52, disposed on an outer surface of the clamp. Toy receiving portion 52 includes a substantially planar, recessed surface 54, having a predetermined length and width slightly greater than the predetermined length and width of the base 24 of the toy device 14 and a predetermined depth slightly greater than the thickness of the edge portion 28 of the toy device 14. Elongated retaining members 56 extend inwardly from two opposed edges of recessed surface 54, and are constructed to define opposed channels 58 dimensioned to receive edge portions 28 of toy device 14 in sliding engagement. Channels 58 are closed at the end opposite the end at which the base is inserted, preventing further movement of the base relative to the recessed surface once the base surface and recessed surface are properly aligned. When edge portions 28 are inserted into channels 58 (arrow B in FIG. 1), planar surface 26 of base 24 slides over camming surface 60 of moveable tab 62, causing tab 62 to be deflected away from surface 26 and allowing planar surface 26 to slide freely over planar surface 54. When the two planar surfaces are aligned, as shown in FIG. 2, tab 62 returns resiliently to its normal position, and acts as a stop to resist relative movement of base 24 with respect to clamp 12 in the direction of tab 62.

Preferably, the clamp 12 also includes a ring, loop or hook 63 on a surface of the clamp spaced from the toy receiving portion. This ring, loop or hook can be used to suspend another item, e.g., a different toy, pacifier or the like.

Other embodiments are within the claims. For example, while the toy receiving portion is illustrated as being on the surface of first J-shaped member 32, a toy receiving portion could be provided instead or in addition on the outer surface of second J-shaped member 34. Moreover, the clamp need not be J-shaped in cross-section; this geometry is preferred when the clamp is designed for use on a high chair tray, but other shapes may be used to suit differently shaped objects to which the toy device is to be attached. The clamp could also be mounted on the object in many different ways, as would be apparent to one skilled in the art; generally it is preferred that the clamp comprise two pieces which can be readily snapped together in secure interlocking engagement and easily released. Also, while the base member of the toy device and the toy receiving portion have been illustrated as being rectangular, other shapes can be used, as would be understood by the artisan. Additionally, the manner in which the toy device is retained by the toy receiving portion may be varied, as would be apparent to one skilled in the art. For example, instead of members 56 which receive edge portions 28, toy receiving portion 52 could have a recess in surface 54 constructed to slidingly receive a protrusion on surface 26, or vice versa, or the two surfaces could be aligned and retained in alignment by any similar means as would be understood by the artisan. Similarly, tab 62 may be replaced by any suitable releasable latch mechanism.

What is claimed is:

1. A children's article attachment system for attaching a children's article to another object, comprising:

a) a children's article comprising:

i) a base having a substantially planar base surface having a predetermined length and width, and a first interlocking portion; and ii) an article mounted on said base; and b) an attachment device comprising:

i) a C-shaped clamp dimensioned to fit around a portion of the object and constructed to be removably mounted on a portion of the object, said clamp having an inner surface, adjacent the object when the clamp is in use, and an outer surface, said C-shaped clamp comprising a pair of J-shaped members having curved portions and straight portions, said J-shaped members being constructed to be snapped together so that their curved portions are opposed and their straight portions are adjacent each other, one of said J-shaped members including a tab and the other of said J-shaped members including an opening constructed to receive said tab in interlocking engagement; and ii) an article receiving portion, disposed on said outer surface, comprising a substantially planar, recessed surface, having a predetermined length and width substantially equal to said predetermined length and width of said base, and having a second interlocking portion constructed for engagement with said first interlocking portion to resist movement of said base relative to said attachment device after said base has been received by said article receiving portion.

2. The attachment system of claim 1 wherein said tab includes a camming surface and a resilient hinged portion to facilitate insertion of said tab into and removal of said tab from said opening.

3. The attachment system of claim 1 wherein one of said J-shaped members further comprises a pair of protrusions, and the other of said J-shaped members includes a pair of openings constructed to receive said protrusions in sliding locked engagement.

4. The attachment system of claim 3 wherein each of said protrusions includes a camming surface constructed to allow said protrusions to slide over a surface of the J-shaped member that includes said openings during initial assembly.

5. The attachment system of claim 1 wherein said first interlocking portion comprises an edge portion disposed around the periphery of said base, and said second interlocking portion comprises a pair of retaining members constructed to extend over a region of said edge portion when said base is received by said article receiving portion.

6. The attachment system of claim 5 wherein said second interlocking portion further comprises a tab that is resiliently moveable between a first position in which it allows said base surface to slide across said recessed surface, and a second, normal, position in which said tab restricts movement of said base relative to said article receiving portion.

7. The attachment system of claim 6 wherein said tab includes a camming surface constructed to facilitate movement of said tab from said second to said first position during insertion of said base into said article receiving portion.

8. The attachment system of claim 1 wherein said article is selected from the group consisting of toys and feeding devices.

9. An attachment device for mounting to an object a children's article including a base having a substantially planar base surface having a predetermined length and width and a first interlocking portion, and a children's article mounted on said base, said attachment device comprising:

i) a C-shaped clamp dimensioned to fit around a portion of the object and constructed to be removably mounted on a portion of the object, said clamp having an inner surface, adjacent said object when the clamp is in use, and an outer surface, said C-shaped clamp comprising a pair of J-shaped members having curved portions and straight portions, said J-shaped members being constructed to be snapped together so that their curved portions are opposed and their straight portions are adjacent each other, one of said J-shaped members including a tab and the other of said J-shaped members including an opening constructed to receive said tab in interlocking engagement; and ii) an article receiving portion, disposed on said outer surface, comprising a substantially planar, recessed surface, having a predetermined length and width substantially equal to said predetermined length and width of said base, and having a second interlocking portion constructed for engagement with said first interlocking portion to resist movement of said article relative to said attachment device after said article has been received by said article receiving portion.

10. The attachment system of claim 9 wherein said article is selected from the group consisting of toys and feeding devices.

11. The attachment system of claim 9 wherein the J-shaped members are permanently associated with each other, and are movable relative to each other between a first, open position, in which the curved portions of the J-shaped members are spaced relatively distant from one another, and a second, closed position, in which the curved portions are spaced relatively closer to each other.

12. The attachment system of claim 9 wherein said tab includes a camming surface and a resilient hinged portion to facilitate insertion of said tab into and removal of said tab from said opening.

13. The attachment system of claim 9 wherein one of said J-shaped members further comprises a pair of protrusions, and the other of said J-shaped members includes a pair of openings constructed to receive said protrusions in sliding locked engagement.

14. The attachment system of claim 13 wherein each of said protrusions includes a camming surface constructed to allow said protrusions to slide over a surface of the J-shaped member that includes said openings during initial assembly.

15. The attachment system of claim 9 wherein said second interlocking portion further comprises a tab that is resiliently moveable between a first position in which it allows said base surface to slide across said recessed surface, and a second, normal, position in which said tab restricts movement of said base relative to said article receiving portion.

16. The attachment system of claim 15 wherein said tab includes a camming surface constructed to facilitate movement of said tab from said second to said first position during insertion of said base into said article receiving portion.

* * * * *